US010856623B2

(12) United States Patent
Jarman-Miller et al.

(10) Patent No.: US 10,856,623 B2
(45) **Date of Patent: *Dec. 8, 2020**

(54) METHOD OF USING EFFICIENT DIE CUTTING PATTERN FOR FOOTWEAR MANUFACTURE

(71) Applicant: NIKE, Inc., Beaverton, OR (US)

(72) Inventors: Luanne E. Jarman-Miller, Beaverton, OR (US); N. Scot Hull, Rye, NH (US); Hsueh-Fang Chen, Taichung (TW)

(73) Assignee: NIKE, Inc., Beaverton, OR (US)

( * ) Notice: Subject to any disclaimer, the term of this patent is extended or adjusted under 35 U.S.C. 154(b) by 514 days.

This patent is subject to a terminal disclaimer.

(21) Appl. No.: 15/172,422

(22) Filed: Jun. 3, 2016

(65) Prior Publication Data

US 2016/0278485 A1 Sep. 29, 2016

Related U.S. Application Data

(63) Continuation of application No. 12/776,846, filed on May 10, 2010, now Pat. No. 9,364,048.

(51) Int. Cl.
*A43B 23/02* (2006.01)
*A43D 8/04* (2006.01)
(Continued)

(52) U.S. Cl.
CPC ..... *A43D 8/06* (2013.01); *A43B 23/0245* (2013.01); *A43D 8/04* (2013.01); *B26F 1/44* (2013.01);
(Continued)

(58) Field of Classification Search
CPC ..... A43B 23/025; A43D 8/04; A43D 8/06; B26F 1/40; B26F 1/44; B26F 1/46; B26F 2001/449; B26F 2001/4481; Y10S 83/937; Y10T 83/0467; Y10T 83/0491; Y10T 83/0577; Y10T 83/06; Y10T 83/9447; Y10T 83/9454
USPC ..... 83/25, 27, 32, 40, 41, 50, 55, 652, 687, 83/691, 694, 697, 901, 937; 12/145 R, 12/142 P, 146 R, 146 C; 36/1, 47–49; 76/107.8
See application file for complete search history.

(56) References Cited

U.S. PATENT DOCUMENTS 198,424 A 12/1877 Spofford
896,478 A 8/1908 Henry
(Continued)

FOREIGN PATENT DOCUMENTS

CA 2513158 A1 1/2007
DE 283574 C 4/1915
(Continued)

*Primary Examiner* — Clark F Dexter
(74) *Attorney, Agent, or Firm* — Klarquist Sparkman, LLP

(57) ABSTRACT

A cutting die for cutting a plurality of parts of an article of footwear from a bulk material. The cutting die includes a first cutting member that cuts a first part of the article of footwear from the bulk material. The cutting die also includes a second cutting member that cuts a second part of the article of footwear from the bulk material. The second cutting member is fixed to the first cutting member to cut the first and second parts together with a single stroke of the cutting die relative to the bulk material. The first and second parts are separate and distinct from each other and have different shapes.

20 Claims, 2 Drawing Sheets

(51) Int. Cl.

| | |
|---|---|
| ***A43D 8/06*** | (2006.01) |
| ***B26F 1/40*** | (2006.01) |
| ***B26F 1/44*** | (2006.01) |

(52) U.S. Cl.

CPC ..... *B26F 2001/449* (2013.01); *Y10S 83/937* (2013.01); *Y10T 83/0467* (2015.04); *Y10T 83/0491* (2015.04); *Y10T 83/0577* (2015.04); *Y10T 83/06* (2015.04); *Y10T 83/9447* (2015.04); *Y10T 83/9457* (2015.04)

(56) References Cited

U.S. PATENT DOCUMENTS

| | | | | |
|---|---|---|---|---|
| 954,559 | A | | 4/1910 | Harry |
| 964,061 | A | * | 7/1910 | Schwaben ..... B26F 1/40 83/128 |
| 999,962 | A | | 8/1911 | Colt |
| 999,981 | A | | 8/1911 | Franklin |
| 1,115,079 | A | | 10/1914 | John |
| 1,321,896 | A | | 11/1919 | Davis |
| 1,536,027 | A | | 4/1925 | Mortimer |
| 1,941,016 | A | | 12/1933 | Mayle |
| 1,962,603 | A | | 6/1934 | Lovell |
| 2,186,589 | A | | 1/1940 | Lovell |
| 2,489,583 | A | | 11/1949 | Messenger et al. |
| 2,548,910 | A | | 4/1951 | Rylander |
| 2,679,291 | A | * | 5/1954 | Collinson ..... A43D 8/06 83/284 |
| 2,846,001 | A | | 8/1958 | Lowell |
| 3,435,461 | A | | 4/1969 | Artzt |
| 3,491,437 | A | | 1/1970 | Small |
| 3,826,170 | A | | 7/1974 | Jones et al. |
| 3,899,949 | A | | 8/1975 | Bystron et al. |
| RE30,520 | E | | 2/1981 | Pierron |
| 4,480,772 | A | | 11/1984 | Gerndt |
| 4,636,348 | A | | 1/1987 | Whiteside |
| 4,819,529 | A | | 4/1989 | Loriot |
| 4,941,183 | A | | 7/1990 | Bruder et al. |
| 5,027,683 | A | | 7/1991 | Kakimoto |
| 5,249,946 | A | | 10/1993 | Marx |
| 6,205,370 | B1 | | 3/2001 | Blaimschein et al. |
| 6,205,900 | B1 | | 3/2001 | Heck et al. |
| 7,047,857 | B2 | | 5/2006 | Adkins |
| 2009/0178523 | A1 | | 7/2009 | Freshwater et al. |

FOREIGN PATENT DOCUMENTS

| | | | |
|---|---|---|---|
| GB | 122099 | A | 1/1955 |
| GB | 1322324 | A | 7/1973 |
| WO | 2007012182 | A1 | 2/2007 |
| WO | 2008097018 | A1 | 8/2008 |

* cited by examiner

METHOD OF USING EFFICIENT DIE CUTTING PATTERN FOR FOOTWEAR MANUFACTURE

CROSS-REFERENCE TO RELATED APPLICATION

This application is a continuation of co-pending application Ser. No. 12/776,846, filed May 10, 2010, the disclosure of which is hereby incorporated by reference in its entirety.

FIELD

The present disclosure relates to footwear and, more particularly, relates to an efficient die cutting pattern for footwear manufacture.

BACKGROUND

Articles of footwear usually include an upper, a midsole, and an outsole. The outsole can be a unitary piece of relatively high-friction material that provides traction for the footwear. Also, the midsole can be made of foam or other similar material disposed between the upper and the outsole for providing cushioned support for the wearer. Moreover, the upper can include panels or sections of thin material, such as leather, textiles, synthetics, etc. that are attached together. The upper can cover a superior portion of the foot and can secure the footwear to the wearer's foot. Also, the upper can include various decorative features, such as visually pleasing shapes, stitching, colored sections, perforations, embossing, and the like, which make the footwear more aesthetically pleasing.

Typically, the panels of material included in the upper are cut from a sheet of bulk material. For instance, the sections can be cut from a bulk sheet of material using a die to increase manufacturing efficiency. More specifically, the cutting die can be operably mounted to a reciprocating punching or stamping machine over an advancing sheet of bulk material. With every stroke of the machine, the die can penetrate and cut the panel (i.e., the blank) from the bulk material. The cut panels can be separated from the surrounding bulk material and joined to other panels to form the upper of the footwear.

The cutting die can be an individual die for cutting one panel for every stroke of the punching machine. In other cases, a plurality of separate, substantially identical cutting dies (i.e., gang dies) can be mounted in a single punching machine such that multiple identical panels are cut with every stroke of the punching machine. In either case, the panels are spaced apart and cut from the same sheet of bulk material.

Although these conventional cutting dies and manufacturing methods have been adequate for their intended purposes, they do suffer from certain disadvantages. For instance, using individual cutting dies as described above can be labor intensive. Furthermore, even when using gang dies, a substantial amount of waste material (i.e., the bulk material between the bulk panels) can be created.

SUMMARY

Accordingly, despite the improvements of known devices described above, there remains a need for a cutting die for cutting a plurality of parts of an article of footwear from a bulk material. The cutting die includes a first cutting member that cuts a first part of the article of footwear from the bulk material. The cutting die also includes a second cutting member that cuts a second part of the article of footwear from the bulk material. The second cutting member is fixed to the first cutting member to cut the first and second parts together with a single stroke of the cutting die relative to the bulk material. The first and second parts are separate and distinct from each other and have different shapes.

A method of forming an article of footwear is also disclosed. The method includes actuating a cutting die relative to a bulk material and cutting a first part of the article of footwear from the bulk material with the cutting die during the actuating of the cutting die. The method further includes cutting a second part of the article of footwear from the bulk material with the cutting die during the actuating of the cutting die. The first and second parts are separate and distinct from each other and have different shapes.

An article of footwear formed according to a method is additionally disclosed. The method includes actuating a cutting die relative to a bulk material and cutting a first part of the article of footwear from the bulk material with the cutting die during the actuating of the cutting die. Furthermore, the method includes cutting a second part of the article of footwear from the bulk material with the cutting die during the actuating of the cutting die. The first and second parts are separate and distinct from each other and have different shapes.

Moreover, a method of forming an article of footwear is disclosed. The method includes operatively coupling a cutting die to an articulating device. The cutting die includes a first cutting member and a second cutting member. The first and second cutting members are integrally coupled together. Furthermore, the method includes actuating the cutting die relative to a bulk material to cut a first goup of parts of the article of footwear from the bulk material. The first group includes a first part cut with the first cutting member and a second part cut with the second cutting member. The first and second parts are separate and distinct from each other and have different shapes. The first and second parts are cut along a common internal cutting line that defines a first edge of the first part and a second edge of the second part. Also, the first and second parts are cut completely away from the bulk material. Moreover, the method includes advancing the cutting die relative to the bulk material and actuating the cutting die relative to the bulk material to cut a second group of the first and second parts. The first and second groups are cut along a common external cutting line that defines a first edge of the first group and a second edge of the second group. The method additionally includes assembling at least one of the first parts and at least one of the second parts into an upper for the article of footwear and coupling the upper to a sole assembly of the article of footwear.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

FIGS. 3A and 3B are top views of a plurality of panels cut with the cutting die of FIG. 2, wherein FIG. 3A shows the panels nested, and wherein FIG. 3B shows the panels separated;

Corresponding reference numerals indicate corresponding parts throughout the several views of the drawings.

DETAILED DESCRIPTION

Example embodiments will now be described more fully with reference to the accompanying drawings.

Figure 1:
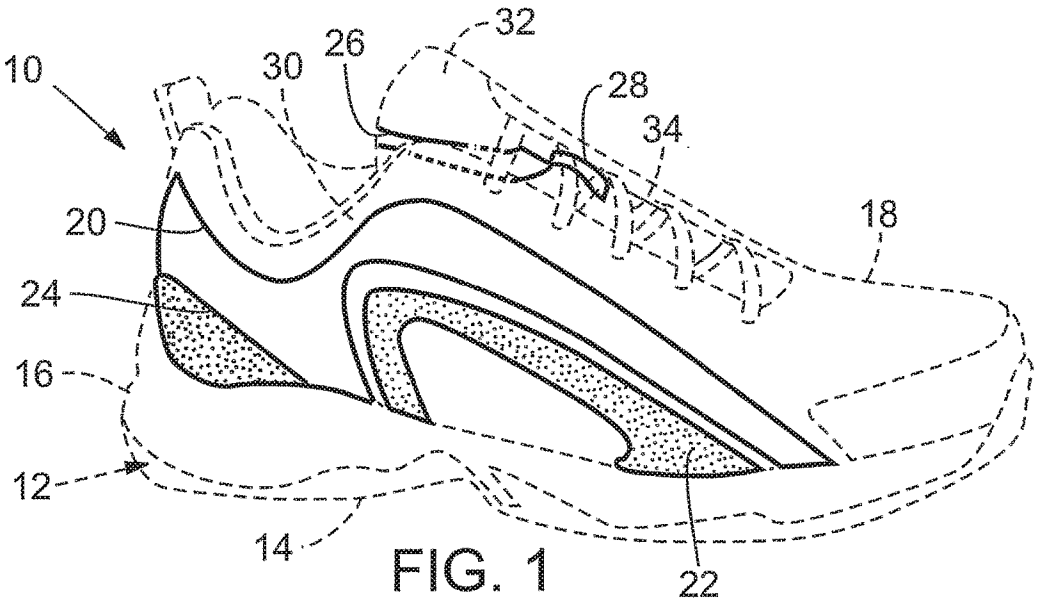
FIG. 1 is a perspective view of an exemplary embodiment of an article of footwear.

Referring initially to FIG. 1, an exemplary embodiment of an article of footwear 10 is illustrated according to various teachings of the present disclosure. In some embodiments, the footwear 10 can be an athletic shoe; however, it will be appreciated that the footwear 10 could be of any other type (e.g., sandal, boot, etc.) without departing from the scope of the present disclosure. An efficient method of manufacturing the footwear 10 will be discussed in greater detail below.

Generally, the article of footwear 10 can include a sole assembly 12 (shown in phantom lines). The sole assembly 12 can include an outsole 14, and a midsole 16. The article of footwear 10 can also include an upper 18. Portions of the upper 18 are shown in phantom lines, and other portions are shown in solid lines.

The outsole 14 can include one or more pieces (e.g., sheets) of relatively high-friction material (such as rubber) for providing traction for the footwear 10. The midsole 16 can include one or more pieces of foam, air bladders, and the like for providing cushioned support for the wearer (not shown). The midsole 16 can be fixedly attached to and disposed between the outsole 14 and the upper 18.

Also, the upper 18 can include a plurality of distinct parts, including a first part 20, a second part 22, a third part 24, a fourth part 26, a fifth part 28, a backing member 30, a tongue 32, and laces 34. The parts 20, 22, 24, 26, 28 and backing member 30 can be made out of any suitable material, such as leather, textile, synthetic material, and the like. Also, the parts 20, 22, 24, 26, 28 and backing member 30 can each be thin sheet-like sections (e.g., panels) of material of different sizes and shapes. It will be appreciated that the parts 20, 22, 24, 26, 28 can have any suitable shape without departing from the scope of the present disclosure.

Figure 6:
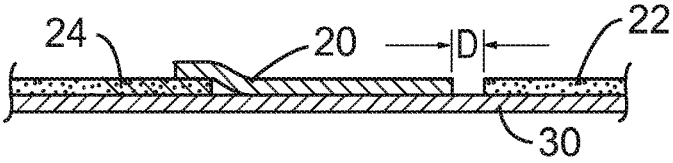
FIG. 6 is a section view of a portion of the article of footwear of FIG. 1.

The first, second and third parts 20, 22, 24 can be layered over and fixed to the backing member 30 (FIGS. 1 and 6). For instance, the parts 20, 22, 24 can be fixed to the backing member 30 by adhesives, stitching, or in any other suitable manner. Also, the first part 20 can be partially layered over and fixed to the third part 24 (FIG. 6). The first and second parts 20, 22 can be spaced apart from each other on the backing member 30 by a distance D (FIG. 6). The fourth and fifth parts 26, 28 can be fixed to the tongue 32 by adhesives, stitching or in any other suitable manner. Also, the laces 34 can be received between the fifth part 28 and the tongue 32. It will be appreciated that the parts 20, 22, 24, 26, 28 can be disposed in any suitable location on the footwear 10 without departing from the scope of the present disclosure. Also, it will be appreciated that the parts 20, 22, 24, 26, 28 can be fixed to any other component of the footwear 10 without departing from the scope of the present disclosure.

Figure 2:
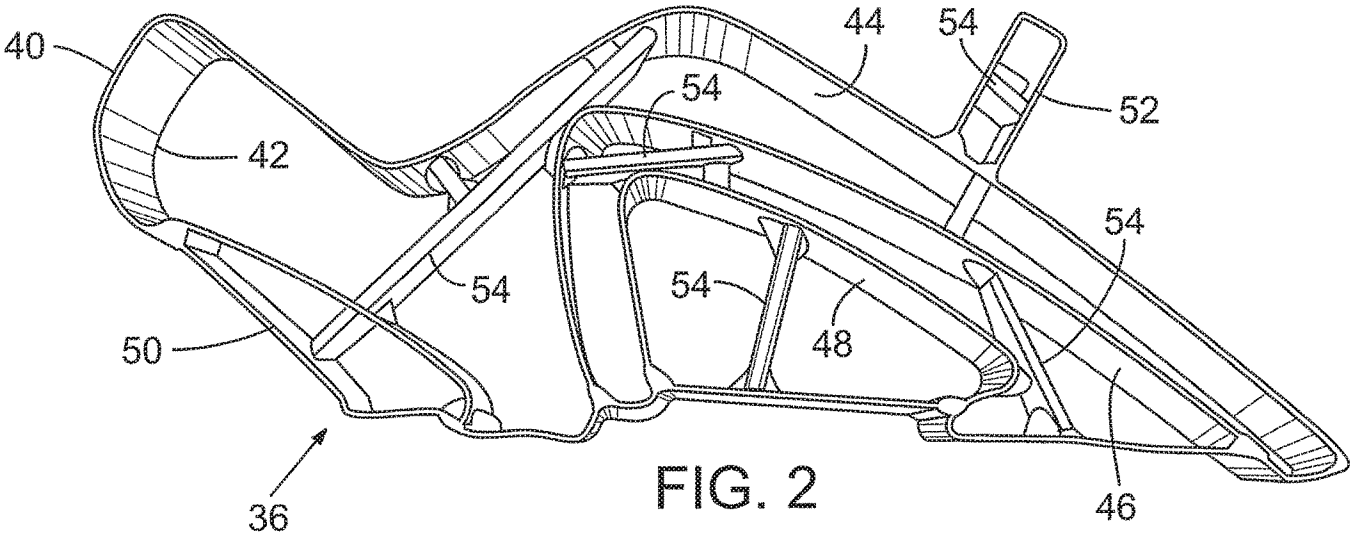
FIG. 2 is a perspective top view of an exemplary embodiment of a cutting die for manufacturing the article of footwear of FIG. 1.

Referring now to FIG. 2, a cutting die 36 is illustrated according to various exemplary embodiments of the present disclosure. As will be described, the cutting die 36 can be a gang die used to make the first, second, third, fourth, and fifth parts 20, 22, 24, 26, 28 of the upper 18. It will be appreciated that the cutting die 36 can be adapted to form any number of parts 20, 22, 24, 26, 28 of the upper 18 and can be adapted to form the parts 20, 22, 24, 26, 28 in any desired shape. As will be described, the cutting die 36 can significantly decrease manufacturing time and cost, and the cutting die 36 can significantly decrease the amount of waste material created during manufacture of the footwear 10.

The cutting die 36 can be substantially hollow and can include a first cutting member 44, a second cutting member 46, a third cutting member 48, a fourth cutting member 50, and a fifth cutting member 52. Each of the cutting members 44, 46, 48, 50, 52 can be thin, rigid, and wall-like and can include a top end 40 and a cutting end 42. The top end 40 can be thicker than the cutting end 42, and the cutting end 42 can be sharpened to facilitate cutting. The cutting members 44, 46, 48, 50, 52 can be integrally fixed to each other such that the cutting die 36 is monolithic. Furthermore, the cutting members 44, 46, 48, 50, 52 can be made out of any suitable material, such as steel.

Also, the cutting members 44, 46, 48, 50, 52 can be contoured so as to correspond in shape to the parts 20, 22, 24, 26, 28, respectively, of the article of footwear 10. Thus, as will be described, the first cutting member 44 can cut the first part 20 from a sheet of bulk material 58, the second cutting member 46 can cut the second part 22, the third cutting member 48 can cut the third part 24, the fourth cutting member 50 can cut the fourth part 26, and the fifth cutting member 52 can cut the fifth part 28. The cutting die 36 can cut these parts 20, 22, 24, 26, 28 in a substantially simultaneous manner for increased efficiency as will be described in greater detail below.

The cutting die 36 can also include a plurality of braces 54. The braces 54 can be elongate and rigid and can extend between individual ones of the cutting members 44, 46, 48, 50, 52. The braces 54 can be fixed at both ends to respective ones of the cutting members 44, 46, 48, 50, 52. As such, the braces 54 can reinforce the respective cutting member 44, 46, 48, 50, 52 so that each cutting member 44, 46, 48, 50, 52 retains its shape.

The cutting die 36 can be manufactured in any suitable fashion. For instance, the cutting members 44, 46, 48, 50, 52 can be bent into a predetermined shape and welded together, and the braces 54 can be similarly welded thereto.

Figure 4:
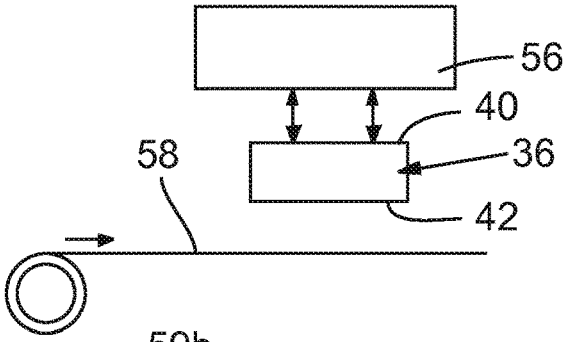
FIG. 4 is a schematic view of a method of cutting the panels of FIGS. 3A and 3B.

As shown in FIG. 4, the cutting die 36 can be operably coupled to an articulating device 56, such as a punching machine. For instance, the articulating device 56 can include a fixture (not specifically shown) of a known type that attaches to one or more of the braces 54 to couple to the die 36. Then, the articulating device 56 can articulate the cutting die 36 relative to the sheet of bulk material 58.

The bulk material 58 can be leather, textile, synthetic material or any other type of material. Also, the bulk material 58 can be a sheet of any size. Moreover, the bulk material 58 can be a flat sheet that is laid out on a work table or other surface. Still further, the bulk material 58 can be accumulated in a roll or can be an individual, flat sheet.

In a single articulation (i.e., stroke) of the cutting die 36, each of the first, second, third, fourth, and fifth parts 20, 22, 24, 26, 28 of the upper 18 can be cut from the bulk material 58. More specifically, as the cutting die 36 approaches the bulk material 58, the cutting end 42 penetrates and cuts through the bulk material 58. Because the cutting members 44, 46, 48, 50, 52 are each continuous, the first, second, third, fourth, and fifth parts 20, 22, 24, 26, 28 are completely separated from the surrounding bulk material 58 and are completely separated from each other (see FIG. 3B).

Figure 3A:
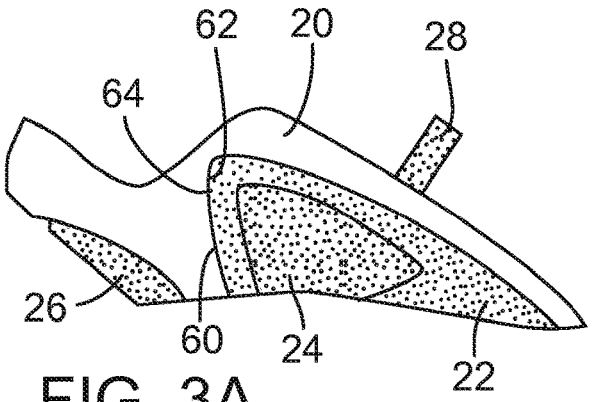
Figure 3B:
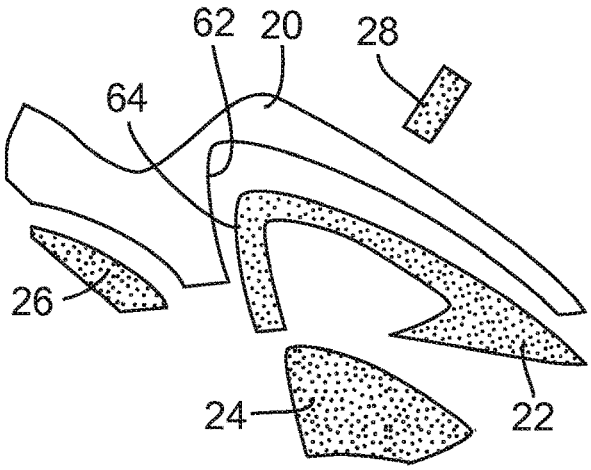

Moreover, because the cutting members 44, 46, 48, 50, 52 are immediately adjacent and nested together, the cutting members 44, 46, 48, 50, 52 can cut the parts 20, 22, 24, 26, 28 along a plurality of common internal cutting lines 60. For example, as shown in FIG. 3A, the first and second parts 20, 22 can be cut along a common internal cutting line 60 that defines both a first edge 62 of the first part 20 and a second edge 64 of the second part 22. Accordingly, little or no waste is created between the first and second parts 20, 22. It will be appreciated that each of the parts 20, 22, 24, 26, 28 cut by the cutting die 36 can be cut along respective internal cutting lines 60 to thereby reduce waste.

Moreover, the bulk material 58 can be advanced relative to the cutting die 36. For instance, the bulk material 58 can be unrolled further to advance the bulk material 58 and/or the articulating device 56 can be driven to move transverse to the bulk material 58. As such, the cutting die 36 can be articulated a second time over a different area of the bulk material 58 to again cut the first, second, third, fourth, and fifth parts 20, 22, 24, 26, 28 of the upper 18.

Figure 5:
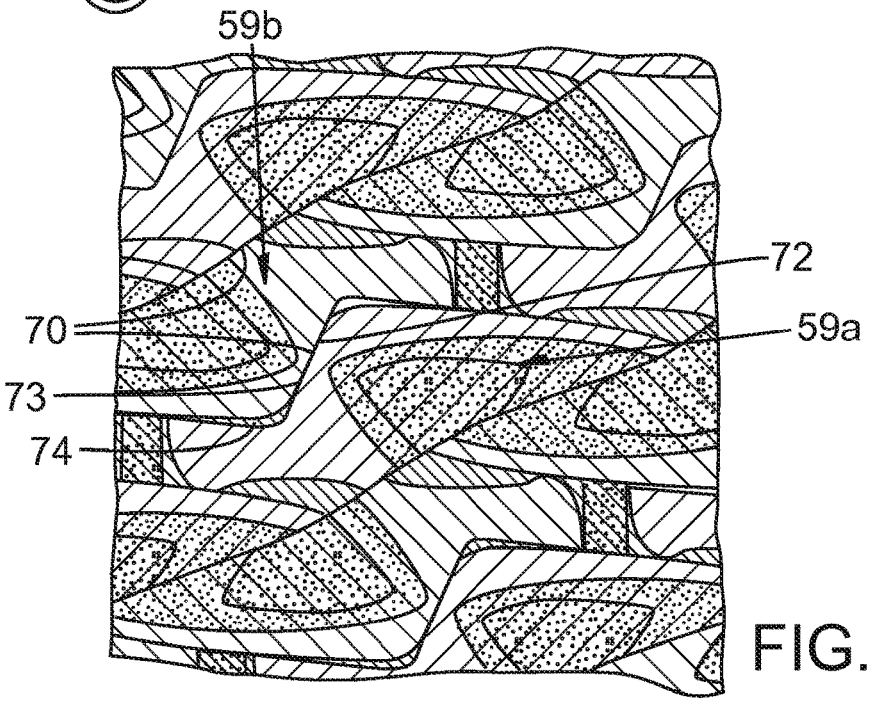
FIG. 5 is a top view of a sheet of bulk material after being cut with the cutting die of FIG. 2.

For example, as shown in FIG. 5, the parts 20, 22, 24, 26, 28 can be cut in a first group 59 *a* with the cutting die 36. Then, the bulk material 58 can be advanced relative to the cutting die 36, and the parts 20, 22, 24, 26, 28 can be cut again in a second group 59 *b*. As such, a plurality of each of the parts 20, 22, 24, 26, 28 can be cut from the bulk material 58 for the manufacture of a plurality of uppers 18.

As shown in FIG. 5, the groups 59 *a*, 59 *b* can be immediately adjacent and nested so as to share a common external cutting line 70. The external cutting line 70 can define a first edge 72 of the first group 59 *a* and a second edge 73 of the second group 59 *b*. As such, a relatively small amount of waste material 74 is created.

Once the groups 59 *a*, 59 *b* have been cut, the parts 20, 22, 24, 26, 28 can be separated from each other (FIG. 3B) and from the waste material 74. Then, the parts 20, 22, 24, 26, 28 can be assembled to other components of the upper 18 as described above.

Furthermore, in some embodiments, parts 20, 22, 24, 26, 28 can be cut from two different sheets of bulk material 58 that differ in color, graphic design, material, texture, etc. Subsequently, some of the parts 20, 22, 24, 26, 28 of one sheet of bulk material 58 can be included with other parts 20, 22, 24, 26, 28 of the other sheet of bulk material 58 to thereby vary the color, graphic design, material, texture, etc. of the footwear 10.

Accordingly, the cutting die 36 of the present disclosure can enhance manufacturing efficiency for the footwear 10. This is because multiple, differently-shaped parts 20, 22, 24, 26, 28 can be cut as a group from bulk material 58 with a single actuation (i.e., stroke). Also, the parts 20, 22, 24, 26, 28 can be nested within the group 59 *a*, 59 *b*, and the groups 59 *a*, 59 *b* can be nested together to reduce waste material 74.

Moreover, in some embodiments, multiple cutting dies 36 can be used cooperatively together to cut parts 20, 22, 24, 26, 28 from the bulk material 58. In some embodiments, these dies 36 can be nested together and can be articulated together or separately. In addition, the cutting die 36 can be used in cooperation with one or more conventional cutting dies, which cut individual parts. Again, the cutting die 36 can be nested with the conventional cutting die(s) in some embodiments.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A method of manufacturing an upper of an article of footwear comprising:

providing a cutting die;

cutting a first group of parts from a first area of a bulk material during a first stroke of the cutting die, the first group including a first part and a second part of the upper, the first part and the second part being separate and distinct from each other and having different shapes, the first part and the second part cut along a common internal cutting line that defines a first edge of the first part and a second edge of the second part; and cutting a second group of parts from a second area of the bulk material during a second stroke of the cutting die, the second group including a first part and a second part, the first part of the second group corresponding in shape to the first part of the first group, the second part of the second group corresponding in shape to the second part of the first group, the second group cut along a common external cutting line that defines a first boundary of the first group and a second boundary of the second group, the first boundary having a first curvature, and the second boundary having a second curvature that is inverse to the first curvature.

2. The method of claim 1, wherein the common internal cutting line of the first group of parts includes a first end that intersects the common external cutting line, and wherein the common internal cutting line of the first group of parts further includes a second end that intersects the common external cutting line.

3. The method of claim 1, further comprising:

advancing the bulk material relative to the cutting die; and cutting a third group of parts from a third area of the bulk material during a third stroke of the cutting die, the third group including a first part and a second part, the first part of the third group corresponding in shape to the first part of the first group, the second part of the third group corresponding in shape to the second part of the first group.

4. The method of claim 1, further comprising assembling the first and second parts of the first group into the upper for the article of footwear.

5. The method of claim 4, further comprising securing the first and second parts of the first group to a backing member of the upper.

6. The method of claim 5, wherein securing the first and second parts to the backing member comprises spacing apart the first and second parts of the first group at a distance away from each other.

7. The method of claim 5, wherein securing the first and second parts to the backing member comprises at least partially layering one of the first and second parts over the other of the first and second parts.

8. The method of claim 1, further comprising operably coupling the cutting die to an articulating device that articulates the cutting die through the first stroke and the second stroke, the cutting die including a first cutting member and a second cutting member, the first cutting member configured to cut the first part of the first group and the second cutting member configured to cut the second part of the first group.

9. The method of claim 1, wherein the cutting of the first part and the second part of the first group comprises cutting the first part to completely separate the first part from the bulk material and cutting the second part to completely separate the second part from the bulk material.

10. The method of claim 1, wherein the bulk material defines a width direction and a length direction, wherein the first area and the second area are offset relative to one another in both the width direction and the length direction.

11. The method of claim 1, wherein the bulk material is a first bulk material;

further comprising cutting a third group of parts from a second bulk material, the second bulk material differing from the first bulk material in at least one of color, graphic design, material, and texture;

the third group of parts including a first part and a second part, the first part of the third group corresponding in shape to the first part of the first group, the second part of the third group corresponding in shape to the second part of the first group; and further comprising assembling the upper of the article of footwear with the first part cut from the first bulk material and the second part cut from the second bulk material.

12. A method of manufacturing parts of an article of footwear from a bulk material, the bulk material defining a width direction and a length direction, the method comprising:

providing at least one gang die with a first cutting member and a second cutting member, the first and second cutting members being fixed together, the first cutting member configured to cut a first part from the bulk material, the second cutting member configured to cut a second part from the bulk material, the second part having a distinct shape from the first part, the at least one gang die configured to cut the first and second parts along a common internal cutting line that defines a first edge of the first part and a second edge of the second part; and actuating the at least one gang die relative to the bulk material to perform at least one stroke to cut a first group of parts and a second group of parts from the bulk material, the first group of parts including the first part and the second part, the second group of parts including the first part and the second part, the first part of the second group corresponding in shape to the first part of the first group, the second part of the second group corresponding in shape to the second part of the first group;

the first group cut along a common external cutting line that partly defines a first boundary of the first group and that partly defines a second boundary of the second group, the first boundary having a first curvature, and the second boundary having a second curvature that is inverse to the first curvature;

the first part of the first group being cut from a first location on the bulk material, the first part of the second group being cut from a second location on the bulk material, the first location being offset from the second location in both the width direction and the length direction.

13. The method of claim 12, wherein actuating the at least one gang die includes actuating the at least one gang die in a first stroke and actuating the at least one gang die in a second stroke.

14. The method of claim 12, wherein actuating the at least one gang die includes actuating a first gang die to cut the first group of parts and actuating a second gang die to cut the second group of parts.

15. The method of claim 12, wherein the common internal cutting line includes an end that intersects the common external cutting line.

16. The method of claim 12, further comprising assembling an upper of the article of footwear to include the first part of one of the first and second groups and the second part of one of the first and second groups.

17. A method of manufacturing parts of an upper of an article of footwear from a bulk material, the method comprising:

providing at least one gang die with a first cutting member and a second cutting member, the first and second cutting members being fixed together, the first cutting member configured to cut a first part from the bulk material, the second cutting member configured to cut a second part from the bulk material, the second part having a distinct shape from the first part, the at least one gang die configured to cut the first and second parts along a common internal cutting line that defines a first edge of the first part and a second edge of the second part; and actuating the at least one gang die relative to the bulk material during to perform at least one stroke to cut a first group of parts and a second group of parts from the bulk material, the first group of parts including the first part and the second part, the second group of parts including the first part and the second part, the first part of the second group corresponding in shape to the first part of the first group, the second part of the second group corresponding in shape to the second part of the first group;

the first group cut along a common external cutting line that partly defines a first boundary of the first group and that partly defines a second boundary of the second group, the first boundary having a first curvature, and the second boundary having a second curvature that is inverse to the first curvature;

the first group being inverted relative to the second group with respect to the bulk material.

18. The method of claim 17, wherein actuating the at least one gang die includes actuating the at least one gang die in a first stroke and actuating the at least one gang die in a second stroke.

19. The method of claim 17, wherein actuating the at least one gang die includes actuating a first gang die to cut the first group of parts and actuating a second gang die to cut the second group of parts.

20. The method of claim 17, wherein the common internal cutting line includes an end that intersects the common external cutting line.

* * * * *